US008882540B2

(12) United States Patent
Yen et al.

(10) Patent No.: US 8,882,540 B2
(45) Date of Patent: Nov. 11, 2014

(54) ELECTRICAL CONNECTOR

(71) Applicant: Chant Sincere Co., Ltd., New Taipei (TW)

(72) Inventors: Ming Hui Yen, New Taipei (TW); Chun Chi Chou, New Taipei (TW)

(73) Assignee: Chant Sincere Co., Ltd., New Taipei (TW)

( * ) Notice: Subject to any disclaimer, the term of this patent is extended or adjusted under 35 U.S.C. 154(b) by 49 days.

(21) Appl. No.: 13/921,326

(22) Filed: Jun. 19, 2013

(65) Prior Publication Data

US 2014/0120775 A1 May 1, 2014

(30) Foreign Application Priority Data

Oct. 25, 2012 (TW) ..... 101139463 A

(51) Int. Cl.
*H01R 24/00* (2011.01)
*H01R 13/6581* (2011.01)
*H01R 27/00* (2006.01)

(52) U.S. Cl.
CPC ..... *H01R 13/6581* (2013.01); *H01R 27/00* (2013.01)
USPC ..... 439/607.27; 439/607.4; 439/660; 439/489

(58) Field of Classification Search
USPC ..... 439/607.27, 607.4, 660
See application file for complete search history.

(56) References Cited

U.S. PATENT DOCUMENTS

| | | | | |
|---|---|---|---|---|
| 6,287,147 | B1 * | 9/2001 | Lin | 439/607.27 |
| 7,646,165 | B2 * | 1/2010 | Ueda et al. | 318/801 |
| 7,901,221 | B1 * | 3/2011 | Li et al. | 439/95 |
| 8,206,166 | B2 * | 6/2012 | Qu et al. | 439/188 |
| 8,535,097 | B2 * | 9/2013 | Yen et al. | 439/607.27 |
| 8,636,546 | B2 * | 1/2014 | He et al. | 439/607.4 |

* cited by examiner

*Primary Examiner* — Xuong Chung Trans
(74) *Attorney, Agent, or Firm* — Bacon & Thomas, PLLC

(57) ABSTRACT

An electrical connector comprising an insulative housing, a plurality of terminals, a detect pin and a shell, includes a insulative housing having a terminal seat extending forwardly from a base portion and configuring a tongue, and defining a receiving room between bottom of the tongue and a shell, and a plurality of terminals installed in the terminal seat containing nineteen pins compacting to transmit first-type signals and with one plus pin compacting to transmit second-type signals, and a shell accommodating the insulative housing and including a first arm and a second arm.

7 Claims, 6 Drawing Sheets

ELECTRICAL CONNECTOR

BACKGROUND OF THE INVENTION

1. Field of the Invention

The present invention relates generally to an electrical connector, and more specifically, to an electrical connector that improving the mating means thereof, wherein providing a solution to insert different type plugs into identical connector free from destructing itself.

2. Description of the Related Art

By year to year, the following standards "High Definition Multimedia Interface", abbreviated as "HDMI" promoted by HDMI Licensing, LLC and "DisplayPort" by VESA, are created to behave in addition with high performance, somehow being the next urge-to-use Input/Output components in the digital world.

HDMI and DisplayPort known as high performance characteristics use commonly nineteen terminals. Except one plus terminal is employed as running advanced function for DisplayPort. The width dimensions of these two were usually different resulted in the appearance differences between HDMI and DisplayPort.

One conventional art discloses an electrical connector of which HDMI and DisplayPort plug are able to be inserted into an identical shielding. Though such connector decreases size and still adopts only single port that seems a great idea to miniaturize connector, however, a problem occurs wherein the conventional art uses a tongue portion in order to guide the plug. In condition of HDMI plug having a small size than DisplayPort plug, conventional art fails to provide a position function in a simple way. So failures always happen during plugging and worsen to the risk of tongue-damaging, even the risk of housing-damaging, as users are trying to accurately position the plug. Looking into many other mating means, such plug connector fails to provide an efficient detecting/guiding mechanism to identify two plugs. Such drawback obviously is a potential risk to the device makers, at the time that devastated quality issue from adopted parts is not allowed, or otherwise it is eventually being harmful to selling products.

SUMMARY OF THE INVENTION

For solving the poor situation occurred in the conventional art, therefore, it is necessary to modify and to find an improved means for mating electrical connector, thereto providing a solution to insert different type plugs into identical connector without bringing destructions itself.

The present invention is ultimately to provide an electrical connector, comprising an insulative housing, a plurality of terminals and a shell. The insulative housing has a terminal seat wherein extending forwardly from a base portion and configuring a tongue, and defines a receiving chamber between bottom of the tongue and a shell. The plurality of terminals is installed in the terminal seat, wherein containing ten terminals upheld by a first surface of said tongue and the other ten terminals upheld by a second surface, wherein nineteen of all terminals are predetermined to perform a first-type function with an external interface plug, and total of all terminals are predetermined to perform a second-type function with the other external interface plug. The shell accommodates the insulative housing, having an opening and a top edge formed at the parameter of said opening, and includes: a first arm situated in one side of said top edge, extending a push portion in curve shape at the end, and a second arm situated in the center of said top edge, extending a stop portion in flat shape at the end. The push portion and stop portion pass through hollows configured on a top surface of said shell and protrude into said receiving chamber. The first arm and second arm is configured with a principle arm of said shell. The fold portion is configured above of said top surface and extends from whichever edge of said shell, wherein said fold portion is extended from said principle arm, and elastically stays above of said top surface.

The fold portion is a U-shape elastic article, which is extended from said principle arm and spaced 0.4 mm~0.5 mm out of said top surface.

The electrical connector further comprises a third arm situated in the other side of said top edge, extending a push portion in curve shape at the end. The push portion passes through a hollow configured on said top surface of said shell and protrudes into said receiving chamber. The third arm is configured on a subsidiary arm of said shell. A fold portion is configured upon said top surface and extends from whichever edge of said shell, wherein said fold portion is extended from said subsidiary arm, and elastically stays above said top surface.

The tongue of terminal seat provides recessions at both top and bottom sides of the tongue for receiving the contact ends of the terminals.

The electrical connector further comprises a detect pin attached to the terminal seat including a body portion, a resilient finger and a soldering tail wherein the body portion disposed in terminal seat and the resilient finger disposed near the tongue.

The insulative housing includes a block holding soldering tails of the terminals and the detect pin through holes on the block. The terminal seat extends backwardly from the base portion and configures two auxiliary portions, wherein the block fixed between the auxiliary portions.

Each auxiliary portion contains an aperture at inner side and the block configures tabs to engage with the apertures thereof.

DETAILED DESCRIPTION OF THE EMBODIMENT(S)

Figure 1:
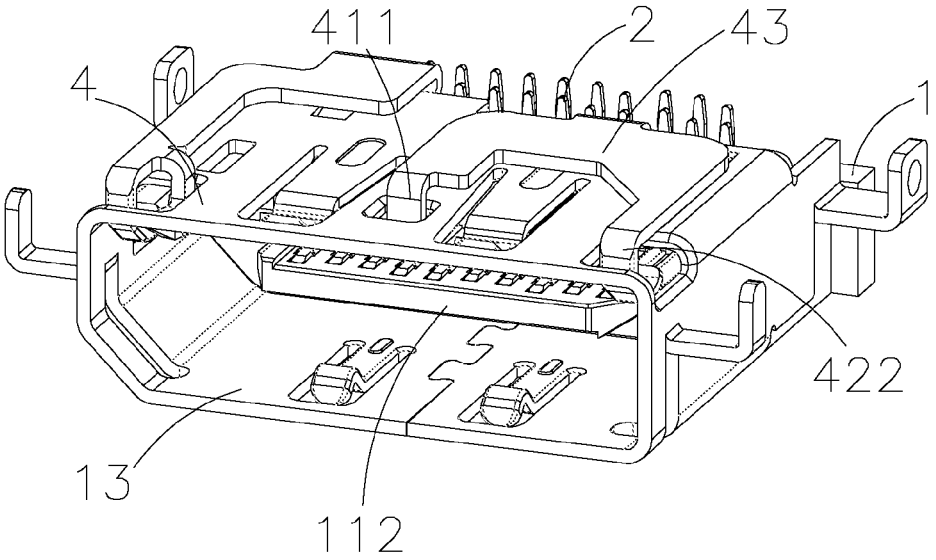
FIG. 1 is a perspective view of the electrical connector formed in accordance with an embodiment of the invention.

As shown in FIG. 1, the present embodiment is illustrated in a perspective view. An electrical connector comprises: an insulative housing 1, a plurality of terminals 2 and a shell. Where a principle arm 43 is configured on the shell 4, more arms, a first arm 422 and a second arm 411, are separately configured on the same end, and elongate to a receiving chamber 13 which is formed between a tongue 112 and the shell 4.

Figure 2:
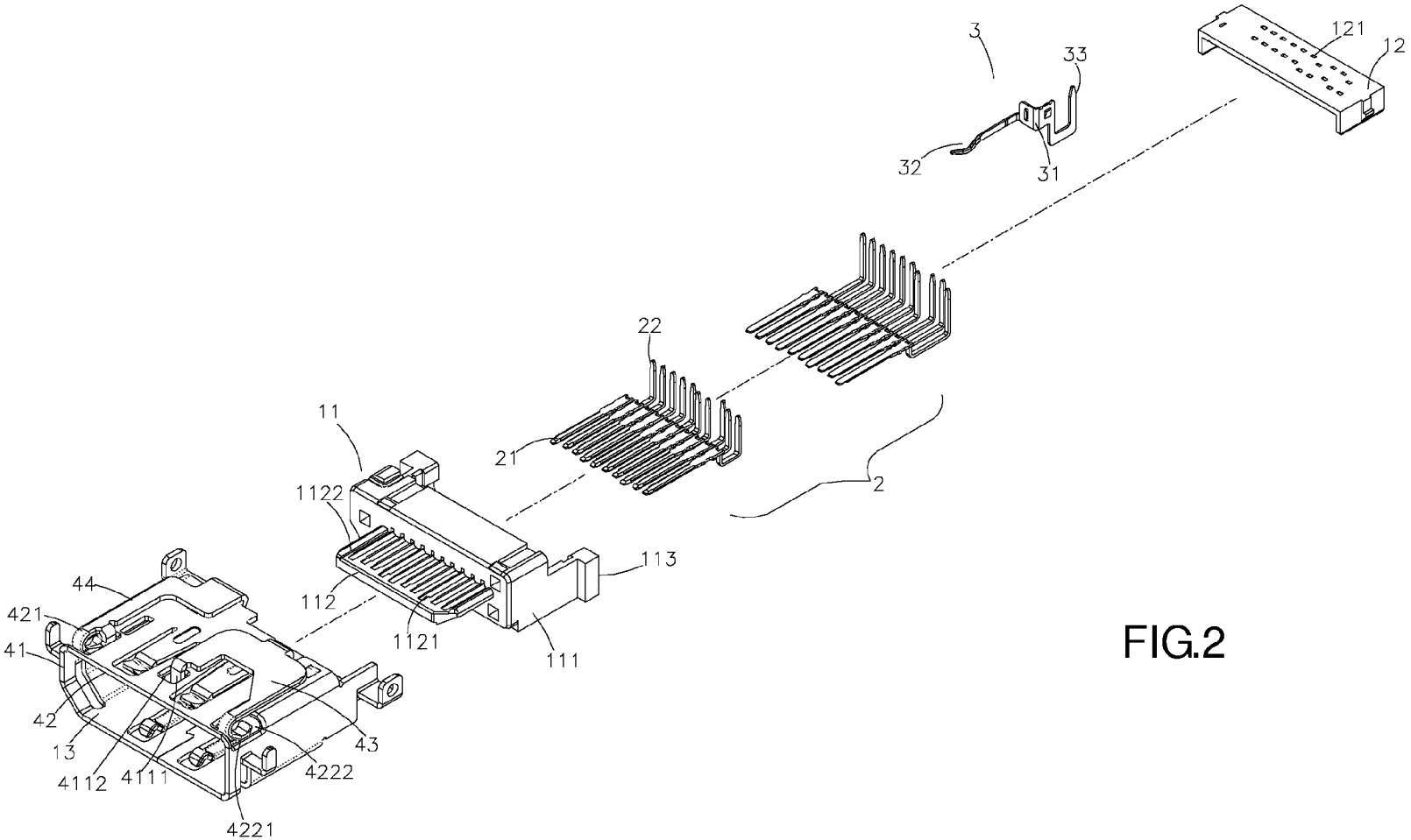
FIG. 2 is an exploded perspective view shown in FIG. 1.
Figure 3:
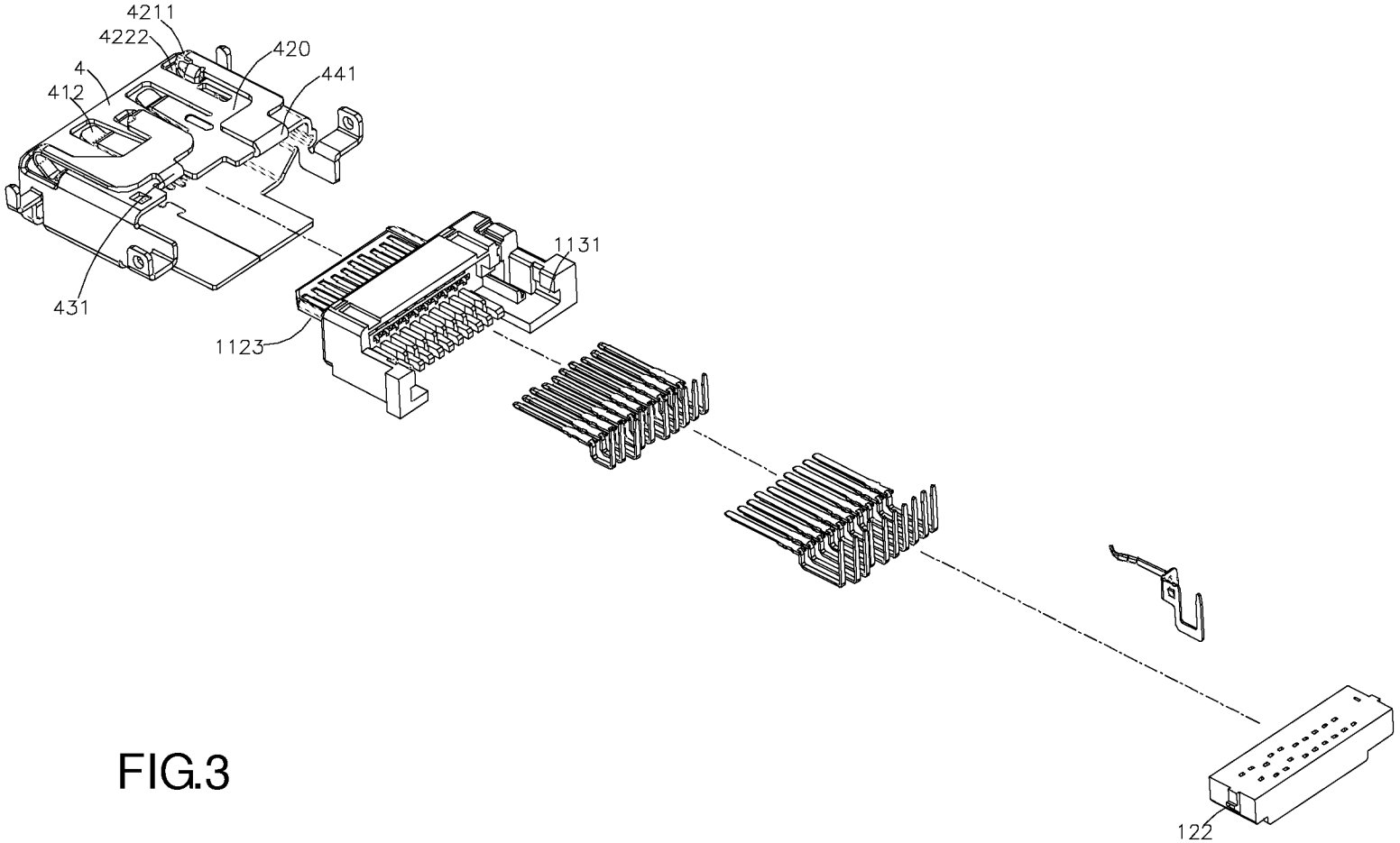
FIG. 3 is another exploded perspective view shown in FIG. 1.

Then, see also FIG. 2 and FIG. 3, which the present embodiment is illustrated as perspective view in accordance with two different coordinates, the insulative housing 1 consists of a terminal seat 11 and a block 12. Terminal seat 11 extended forwardly from a base portion 111 configures a tongue 112, wherein recessions 1121 are provided at both top and bottom sides of tongue 112. Terminal seat 11 extended backwardly from base portion 111 configures two auxiliary portions 113 wherein each auxiliary portion 113 contains an aperture 1131 at inner side. Block 12 consists of holes 121 on surface and tabs 122 which configure to engage with apertures 1131.

A plurality of terminals 2 is installed in terminal seat 11 wherein each terminal has a contact end 21 disposed in the recession 1121 and a soldering tail 22 passing through the hole 121 of block 12. A plurality of terminals 2 contains ten terminals upheld by a first surface 1122 (hereafter, upper surface) of the tongue 112 and the other ten terminals upheld by a second surface 1123 (hereafter, bottom surface). Additionally, nineteen of all terminals, that is referred to ten on the first surface 1122 and nine on the second surface 1123 of the tongue 112, are predetermined to perform HDMI function with an external interface plug 5 for first type. And, the total of all terminals that is referred to the same nineteen terminals and one additional pin (the twentieth terminal) on the second surface 1123, is able to be compacting to DisplayPort Standard.

A detect pin 3 is attached to terminal seat 11 and comprises a body portion 31 disposed at one of auxiliary portions 113, a resilient finger 32 disposed near tongue 112, and a soldering tail 33 passing through the hole 121 of block 12.

Shell engages with insulative housing 1 and further includes an opening 41 connecting to external plug connector and a top edge 42 formed at the parameter of the opening 41, where so the top edge 42 is configured at the border between the opening 41 and a top surface 420 of the shell 4. The receiving chamber 13 which is formed between the tongue 112 and the shell 4, keeps itself as a thorough passage to the opening 41. On the top surface 420 of shell 4, at least one latch 412 joins the receiving chamber 13 in order to lock a plug. The first arm 422 and the second arm 411 are configured on the principle arm 43 which composes as one part of the shell 4. A fold portion 431 is configured on the top surface 420 and extends from whichever edge of the shell 4; precisely said, the fold portion 431 is extended from the principle arm 43, and elastically stays above the top surface 420.

The first arm 422 situated in one side of the opening 41 extends a push portion 4221 in curve shape at the end; and the push portion 4221 passes through a hollow 4222 configured on the top surface 420 of the shell 4 and protrudes into the receiving chamber 13, wherein the first arm 422 is configured on the principle arm 43 of the shell 4 and towards to the opening 41, of which the push portion 4221 comprises in curve shape.

The second arm 411 situated in the center of the opening 41 extends a stop portion 4111 in flate shape at the end; and the stop portion 4111 passes through another hollow 4112 configured on the top surface 420 of the shell 4 and protrudes into the receiving chamber 13, wherein the second arm 411 is configured on the principle arm 43 of the shell 4 and towards to the opening 41, of which the stop portion 4111 comprises in flat shape.

A preferable embodiment as above described therefore establishes an ideal electrical connector; an advanced effect can be made by the further practice of the electrical connector as following.

The third arm 421 situated in the other side of the opening 41 extends a push portion 4211 in curve shape at the end; and the push portion 4211 passes through a hollow 4212 configured on the top surface 420 of the shell 4 and protrudes into the receiving chamber 13, wherein the third arm 421 is configured on a subsidiary arm 44 of the shell 4 and towards to the opening 41, of which the push portion 4211 comprises in curve shape. The subsidiary arm 44 composes as one part of the shell 4. A fold portion 441 is configured on the top surface 420 and extends from whichever edge of the shell 4; precisely said, the fold portion 441 is extended from the subsidiary arm 43, and elastically stays above the top surface 420. The subsidiary arm 43 selectively extends a guiding portion 4213 that passes through the hollow 4212 and protrudes into the receiving chamber 13 as well, at the side where the push portion 4211 confronts the tongue 112.

Figure 4:
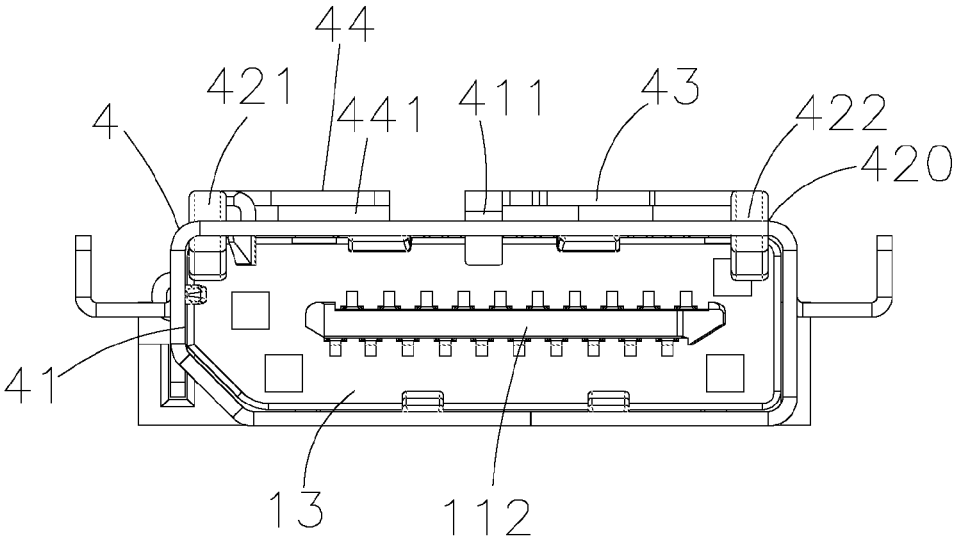
FIG. 4 is a front view of the electrical connector formed in accordance with an embodiment of the invention.

As shown in FIGS. 2-4, as assembling connector, first of all, a plurality of terminal 2 is inserted into the base portion 111 of the terminal seat 11, wherein each contact 21 of terminal is disposed in the recession 1121 which is configured at the tongue 112 wherever surfaces held. Next, the body portion 31 of the detect pin 3 is mounted on the one of auxiliary portion 113 of the terminal seat 11, wherein the resilient finger 32 of the detect pin 3 extends and is retained close to one side of tongue 112.

Soldering tails 22, 33 of both terminals 22 and detect pin 3 are passing through the hole 121 of the block 12. Thus, the block 12 holding the terminals 22 approximately is pressed into the terminal seat 11, wherein latches 122 of block 12 engages with the aperture 1131 of the auxiliary portion 113 and fixes.

Shell 41 accommodates the insulative housing 1 defining a receiving chamber between the bottom of tongue 112 and the shell 4. A metal material of shell 4 is stamped and forms the principle arm 43 in connection with the first arm 422 and the second arm 411 through the fold portion 431; then the push portion 4221 and the stop portion 4111 are so formed as well. Such unfinished material is bent in a large angle, so that the principle arm 43 is folded up to the top surface 420 and the push portion 4221, the stop portion 4111 pass through the hollow 4222, 4112. In the end, the first arm 422 situated in one side of the opening 41 extends a push portion 4221 in curve shape at the end; the second arm 411 situated in the center of the opening 41 extends a stop portion 4111 in plate shape at the end. The fold portion 431 is a U-shape elastic article (see FIG. 7) having an efficient elasticity where the principle arm 43 and the top surface 420 space out of 0.4 mm~0.5 mm.

Figure 5:
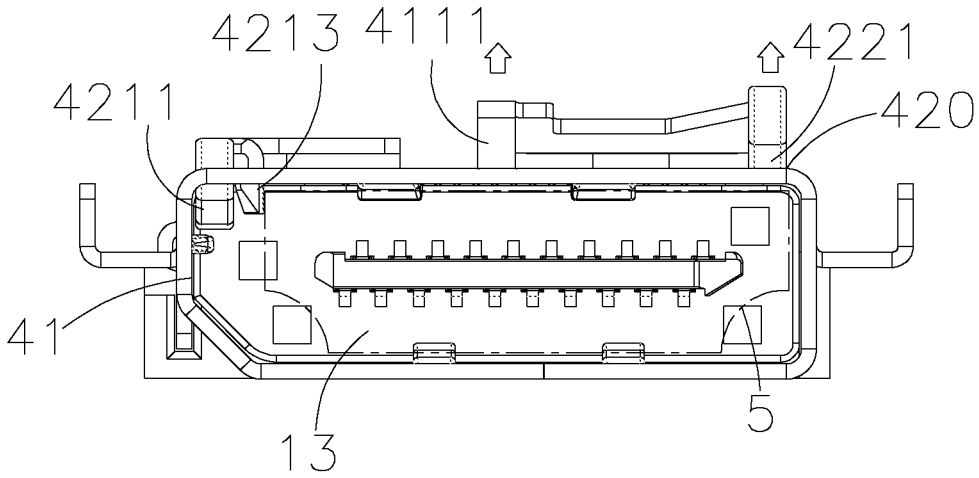
FIG. 5 is a front view of the electrical connector shown in FIG. 4, illustrated a first-type plug outline inside the connector.
Figure 6:
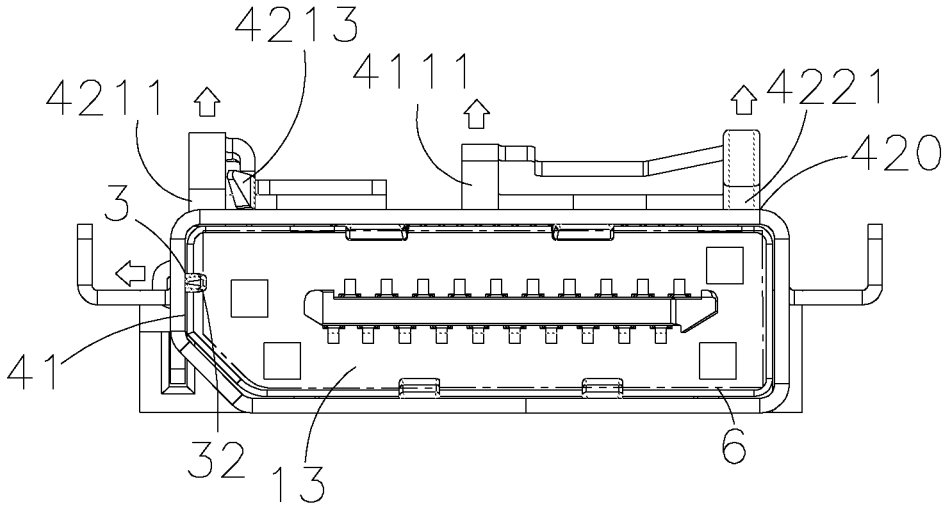
FIG. 6 is a front view of the electrical connector shown in FIG. 4, illustrated a second-type plug outline inside the connector.

Compared FIG. 4 to FIG. 5 and FIG. 6, as the first-type plug 5 inserting into the receiving chamber 13, in a predetermined (ideal) position which is aligned to right side of the opening 41, the plug 5 pushes the push portion 4221 of first arm 422 and leads to physically lift up. By such lifting, the second arm 411 and the stop portion 4111 lift up as well in result of the connection of the first arm 422 and the second arm 411 via the principle arm 43. The opening 41 becomes a passable channel in center with the receiving chamber 13 so that the plug 5 will be easy to insert in (see FIG. 5). This movement can approximately be deployed with the second-type plug 6 (see FIG. 6).

In case of the plug 5 inserting into in an unwanted position or missing predetermined position, e.g. inserting at center or left side of the opening 41, the movement of the plug 5 would be ceased by the stop portion 4111 so that the user should aware of the irregularity and re-position the plug 5. It is easy to think about and note that the first-type plug 5 should be a connector having a size smaller than the second-type plug 6 for which the shell 4 is ever defined with an outline fit. That is to say, the shell 4 is closely designed to provide the second-type plug 6 insert in without a particular attention of position. In other hand, the shell 4 provides a protection against collision between the first-type plug 5 and the tongue 112 via the stop portion 4111 of the first arm 422 in any case of irregular position.

As the second-type plug 6 inserting into the receiving chamber 13, which basically deploys the movement from the first-type plug 5, the resilient finger 32 of the detect pin 3 is been butted and thus contacts to the plug 6 with a metal shielding. For sake of the detect pin 3 being configured in the left side of shell 4, there is no way that the first-type plug 5 touch the detect pin 3 without lifting up the stop portion 4111, and by the description above: the stop portion 4111 lifts up in condition of the push portion 4221 firstly lifts up which means the first-type plug 5 inserting in a ideal position aligned to right side of the opening 41. Therefore, if the detect pin 3 is not butted, the chip transmits signals of first type; if the detect pin 3 is butted, the chip transmits signals of second type. Thus, it provides a simple way that an electrical connector is able to distinguish types of plug.

Figure 7:
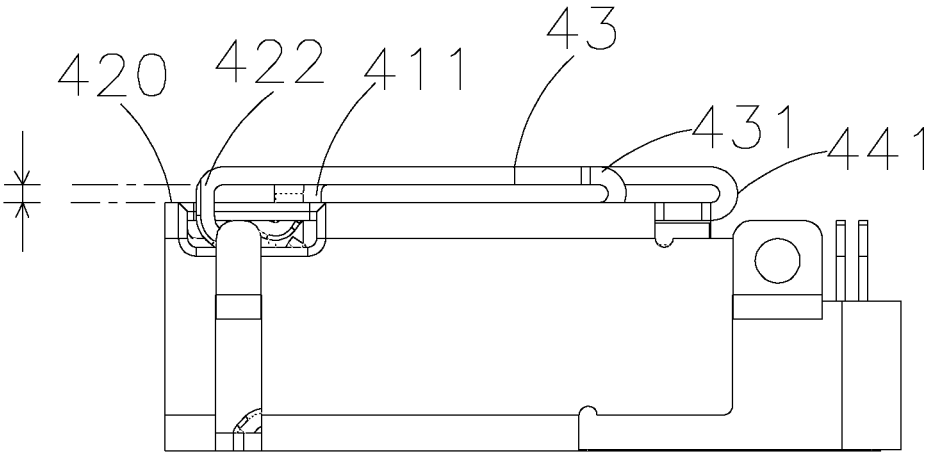
FIG. 7 is a side view of the electrical connector before connecting with a first-type plug connector in accordance with an embodiment of the invention.
Figure 8:
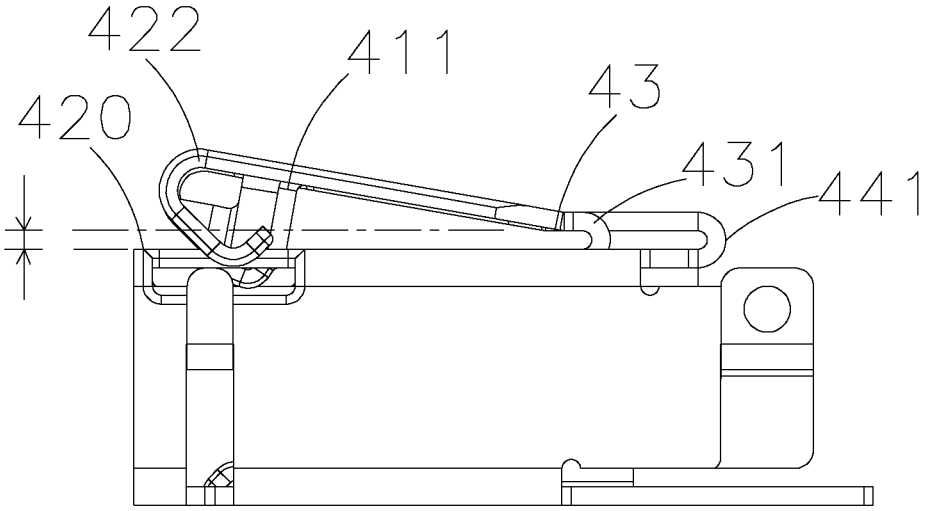
FIG. 8 is a side view of the electrical connector shown in FIG. 7 after connecting with a first-type plug connector.

As shown in FIGS. 7-8, the principle arm 43 and the top surface 420 space out of 0.4 mm~0.5 mm that determines the elasticity of the first arm 422 and the second arm 411. This is essential whether the elasticity is strong enough to support the principle arm 43 holding arms 422, 411 up; in the other hand, to keep the principle arm 43 resilient for remaining itself stand-by. If the height between the principle arm 43 and the top surface 420 is low and they becomes too closed to each other, the elastic article 431 is smaller, and in physically, the elasticity coefficient is not good enough, where most of materials forming shell 4 are metals e.g. bronze or phosphor bronze. On the contrary, if the height between the principle arm 43 and the top surface 420 is high, the elasticity is getting better; however, the connector becomes higher, which is a problem for mechanical design where today laptop and LCD TV change face into thinner and flatter.

Compared FIG. 4 to FIG. 5 and FIG. 6, as the first-type plug 5 inserting into the right side of the receiving chamber 13 which accommodates the plug 5 and remains some space in left, the third arm 421 configured on the shell 4 and extends a push portion 4211 in curve shape at the end; and the push portion 4211 protrudes into the receiving chamber 13, which is able to correct the position of the plug 5. The third arm 421 is preferably configured on a subsidiary arm 44 which composes as one part of the shell 4. A fold portion 441 is configured on the top surface 420 and extends from whichever edge of the shell 4, basically formed identical as the principle arm 43 did. The guiding portion 4213 is able to guide the plug 5. As the second-type plug 6 inserting into the receiving chamber 13, the push portion 4211 lifts up, the opening 41 becomes a passable channel with the receiving chamber 13. The fold portion 441 of subsidiary arm 44 is an elastic article performing an efficient elasticity just like the principle arm 43 being.

Figure 9:
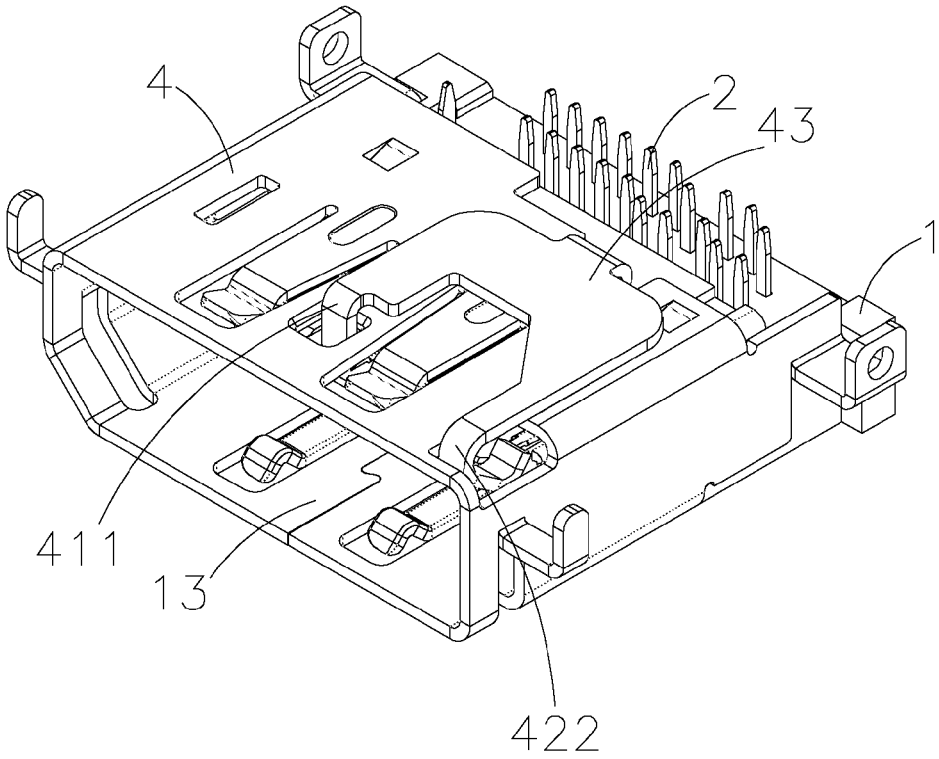
FIG. 9 is a perspective view of the electrical connector formed in accordance with another embodiment of the invention.
Figure 10:
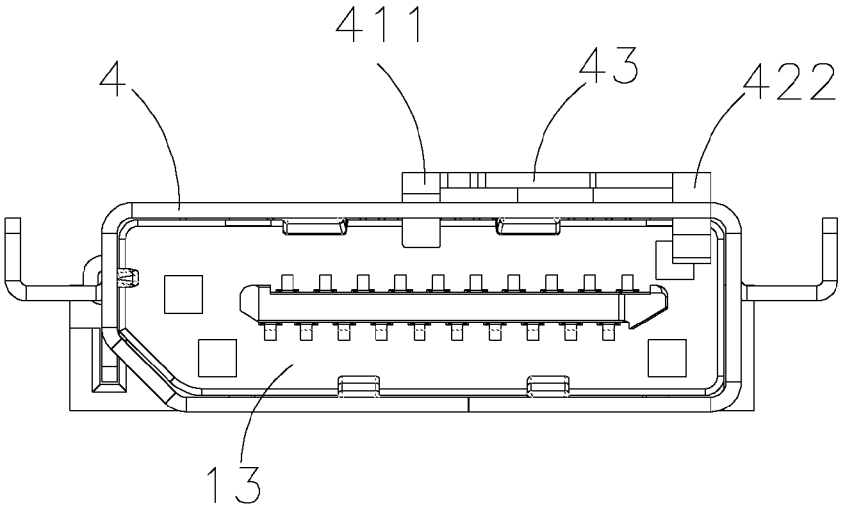
FIG. 10 is a front view of the electrical connector shown in FIG. 9.

As shown in FIGS. 9-10, the other embodiment is illustrated in a perspective view and front views. An electrical connector comprises: an insulative housing 1, a plurality of terminals 2 and a shell 4. Where a principle arm 43 is configured on the shell 4, more arms, a first arm 422 and a second arm 411, are separately configured on the same end, and elongate to a receiving chamber 13 which is formed between a tongue 112 and the shell 4. This embodiment discloses an electrical connector having no subsidiary arm 44 and third arm 421. No matter how, such embodiment in accordance with the present invention can satisfy the main purpose as well.

While the invention has been described in terms of various specific embodiments, those skilled in the art will recognize that the invention can be practiced with modification within the spirit and scope of the claims.

What is claimed is:

1. An electrical connector, comprising:

an insulative housing having a terminal seat extending forwardly from a base portion to configure a tongue, and defining a receiving chamber between bottom of said tongue and a shell; and a plurality of terminals installed in said terminal seat containing ten terminals upheld by a first surface of said tongue and the other ten terminals upheld by a second surface, wherein nineteen of all terminals are predetermined to perform a first-type function with an external interface plug, and total of all terminals are predetermined to perform a second-type function with the other external interface plug; and said shell accommodating said insulative housing, having an opening and a top edge formed at the parameter of said opening, and including:

a first arm situated in one side of said top edge, extending a push portion in curve shape at the end, a second arm situated in the center of said top edge, extending a stop portion in flat shape at the end, said push portion and stop portion passing through hollows configured on a top surface of said shell and protruding into said receiving chamber, said first arm and second arm being configured with a principle arm of said shell, a fold portion being configured above of said top surface and extending from whichever edge of said shell, wherein said fold portion is extended from said principle arm, and elastically stays above of said top surface.

2. The electrical connector of claim 1, wherein said fold portion is a U-shape elastic article, which is extended from said principle arm and spaced 0.4 mm~0.5 mm out of said top surface.

3. The electrical connector of claim 1, further comprising:

a third arm situated in the other side of said top edge, extending a push portion in curve shape at the end, said push portion passing through a hollow configured on said top surface of said shell and protruding into said receiving chamber, said third arm being configured on a subsidiary arm of said shell, a fold portion being configured upon said top surface and extending from whichever edge of said shell, wherein said fold portion is extended from said subsidiary arm, and elastically stays above said top surface.

4. The electrical connector of claim 1, wherein said tongue of the terminal seat providing recessions at both top and bottom sides of said tongue, for receiving the contact ends of said terminals.

5. The electrical connector of claim 1, further comprising:

a detect pin attached to said terminal seat including a body portion, a resilient finger and a soldering tail wherein said body portion disposed in terminal seat and said resilient finger disposed near said tongue.

6. The electrical connector of claim 5, wherein said insulative housing including a block holding said detect pin and said soldering tails of the terminals through holes on said block, and said terminal seat extending backwardly from said base portion to configuring two auxiliary portions, wherein said block fixed between said auxiliary portions.

7. The electrical connector of claim 6, wherein each auxiliary portion containing an aperture at inner side and said block configuring tabs to engage with said apertures.

* * * * *